US005611483A

United States Patent [19]

Sciortino

[11] Patent Number: 5,611,483

[45] Date of Patent: Mar. 18, 1997

[54] COIN AND CURRENCY RECEPTACLE ASSEMBLY FOR MONEY OPERATED MACHINES

[75] Inventor: Michael J. Sciortino, Arlington Heights, Ill.

[73] Assignee: Glenview Security Systems, Glenview, Ill.

[21] Appl. No.: 321,221

[22] Filed: Oct. 11, 1994

[51] Int. Cl.[6] ..... G07B 15/00

[52] U.S. Cl. ..... 232/15; 232/43.2

[58] Field of Search ..... 232/1 D, 15, 32, 232/43.2

[56] References Cited

U.S. PATENT DOCUMENTS

| | | | |
|---|---|---|---|
| 1,632,536 | 6/1927 | Breen | 232/1 D |
| 3,547,344 | 12/1970 | Christensen | 232/15 |
| 3,653,586 | 4/1972 | Bonneson | 232/15 |
| 3,677,461 | 7/1972 | Nitschneider | 232/15 |
| 3,807,627 | 4/1974 | Nitschneider | 232/15 |
| 4,177,920 | 12/1979 | Sciortino | 232/16 |
| 4,194,683 | 3/1980 | Finke et al. | 232/15 |
| 4,289,269 | 9/1981 | Sciortino | 232/16 |
| 4,291,831 | 9/1981 | Domkowski | 232/15 |
| 4,359,184 | 11/1982 | Sciortino | 232/16 |
| 4,372,479 | 2/1983 | Sciortino | 232/15 |
| 4,456,165 | 6/1984 | Sciortino | 232/15 |

FOREIGN PATENT DOCUMENTS

| | | | |
|---|---|---|---|
| 484851 | 5/1992 | European Pat. Off. | 232/1 D |

*Primary Examiner*—Michael J. Milano

*Attorney, Agent, or Firm*—Silverman, Cass & Singer, Ltd.

[57] ABSTRACT

An assembly is comprised of a pair of plastic molded units which can be assembled substantially universally in coin vending machines. A first unit is adapted to be fixedly installed in a dedicated location in the machine for passing coins therethrough which were inserted into the machine for activating it. A second unit is constructed to be removably assembled to said first unit for receiving the coins passing through the first unit. The second unit has a flexible bag secured thereon into which the coins are stored after passing through the second unit. The bag has two separated storage pockets, one of the pockets stores the coins. The second pocket is available for storing paper currency which may have been used to activate the machine. The bag also can be provided with a pocket for holding the computer print-out from the machine. The first unit has a spring-biased closure member normally biased to a closed position over the upper end of the passageway therethrough for coins inserted into the machine. The second unit has an integral cam which engages said closure member when the two units are assembled together by sliding the second unit into said first unit. The two units have a cooperating spring biased pin and socket lock for retaining the units in their locked assembly.

12 Claims, 3 Drawing Sheets

Fig. 6
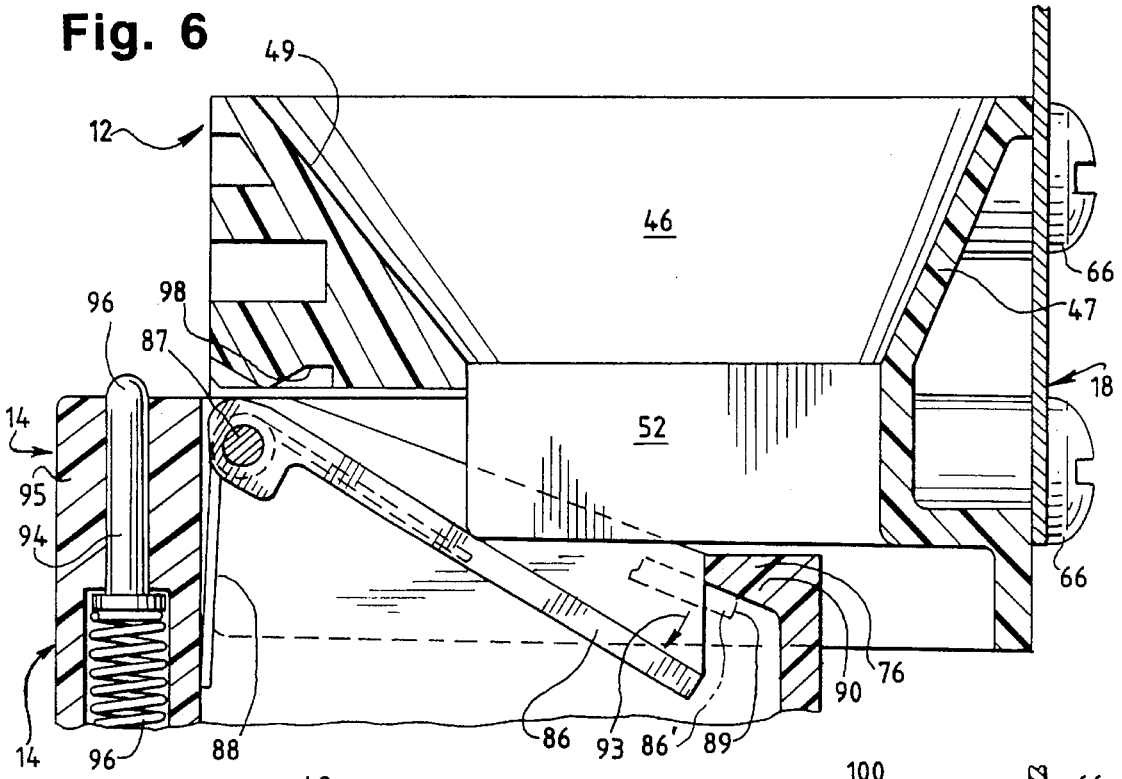
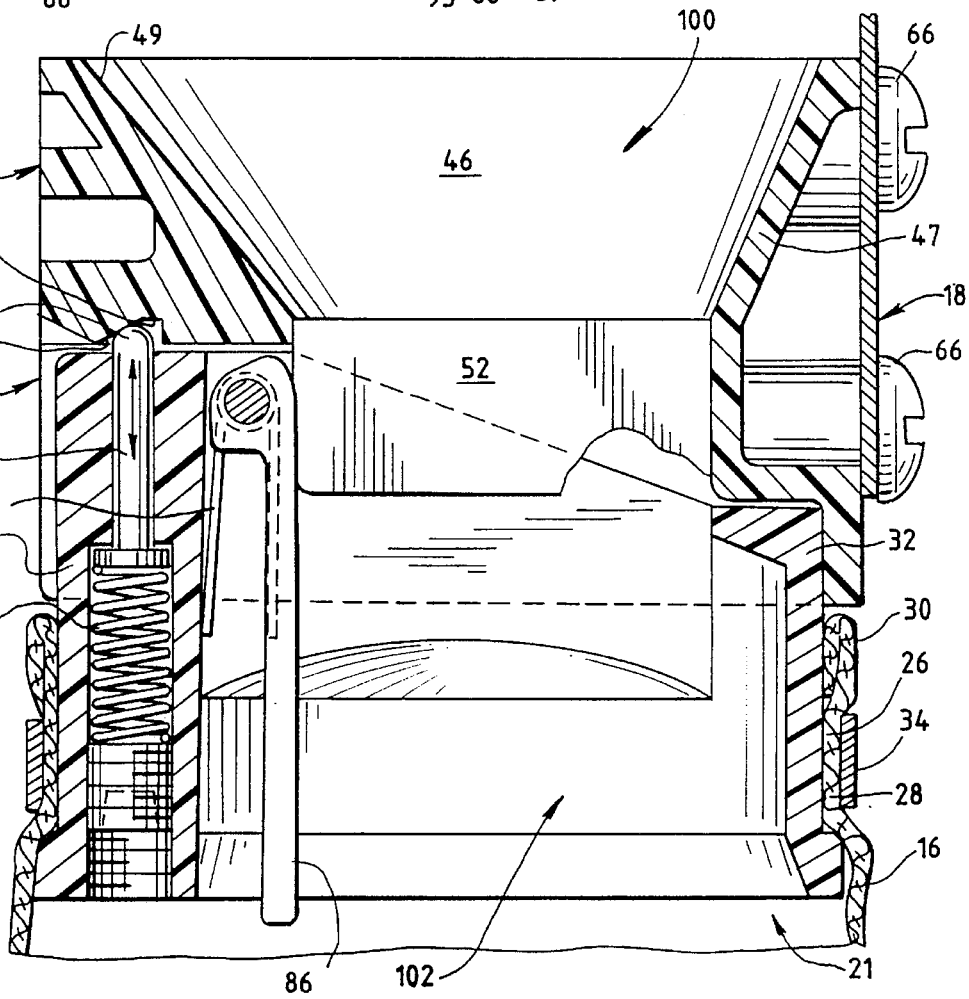
Fig. 7

COIN AND CURRENCY RECEPTACLE ASSEMBLY FOR MONEY OPERATED MACHINES

BACKGROUND OF THE INVENTION

This invention relates generally to receptacles of the type assembled to coin operated vending machines, and more particularly, provides an improved coin and paper currency receptacle assembly comprised of a pair of cooperating units of which one unit is adapted to be fixedly mounted on the interior of the vending machine for receiving coins therethrough and the second unit is adopted to be removably assembled to the said one unit in position to store the coins passing through said one unit. Further, said second unit is comprised of a pair of storage compartments for holding coins and paper currency respectively and a pocket for holding a computer printout of the money received through the machine.

Vending machines of current design normally have receptacles installed in the interior of the machine in position to receive coins which have been inserted to activate the vending machine. Machines of current design also may have a mechanism which can be activated by means of paper currency inserted into a designated slot on the face of the machine. However, the paper currency usually is stored in the machine separately from the coin currency. Periodically, the machine is serviced by a service man who opens the machine, removes the coin loaded receptacle, and replaces it within a special prefabricated position in the machine. The paper currency is separately collected from a currency receiving storage space in the machine. The collected coins and currency together are then deposited by the service man at an authorized accounting station.

Heretofore, such coin collecting receptacles have been fabricated of a pair of interacting parts, which included spring biased slides and spring catch mechanisms of somewhat complicated and expensive design. Typical examples of such structures are depicted in U.S. Pat. Nos. 4,177,920, 4,372,479, 4,289,269, 4,359,184 and 4,456,165. The use of a bag into which the coins are collected is shown in these patents, the bag being attached to one of the interacting parts and is withdrawn when the said one part is separated from the second part for collecting the coins by a service man. Generally, such coin receptacle devices have required security means for locking the receptacle automatically when the coin box of the device was removed by the service man.

In recent times, coin vending machines have computer capability incorporated therein which automatically produces an accounting record of the money inserted into the machine to activate it. The money may be in the form of coins or paper currency. The provision of such computer records has eliminated the need for security triggering means which locks the coin receptacle when a service man removes the receptacle as shown, for instance, in U.S. Patent No. 4,372,479.

SUMMARY OF THE INVENTION

The herein invention is comprised of a pair of plastic molded units which can be assembled substantially universally in coin vending machines. A first unit is adapted to be fixedly installed in a dedicated location in the machine for passing coins therethrough which were inserted into the machine for activating it. A second unit is constructed to be removably assembled to said first unit for receiving the coins passing through the first unit. The second unit has a flexible bag secured thereon into which the coins are stored after passing through the second unit.

The bag has two separated storage pockets, one of the pockets stores the coins. The second pocket is available for storing paper currency which may have been used to activate the machine. The bag also can be provided with a pocket for holding the computer print-out from the machine.

The first unit has a spring-biased closure member normally biased to a closed position over the upper end of the passageway therethrough for coins inserted into the machine. The second unit has integral cam means which engage said closure member when the two units are assembled together by sliding the second unit into said first unit. The two units have a cooperating spring biased pin and socket locking means for retaining the units in their locked assembly.

BRIEF DESCRIPTION OF THE DRAWINGS

FIG. 6 is a fragmentary, vertical sectional view taken through the two units shown partially assembled together; and FIG. 7 is a fragmentary, vertical sectioned view taken through the two units assembled together.

DESCRIPTION OF PREFERRED EMBODIMENT

Figures 1, 2:
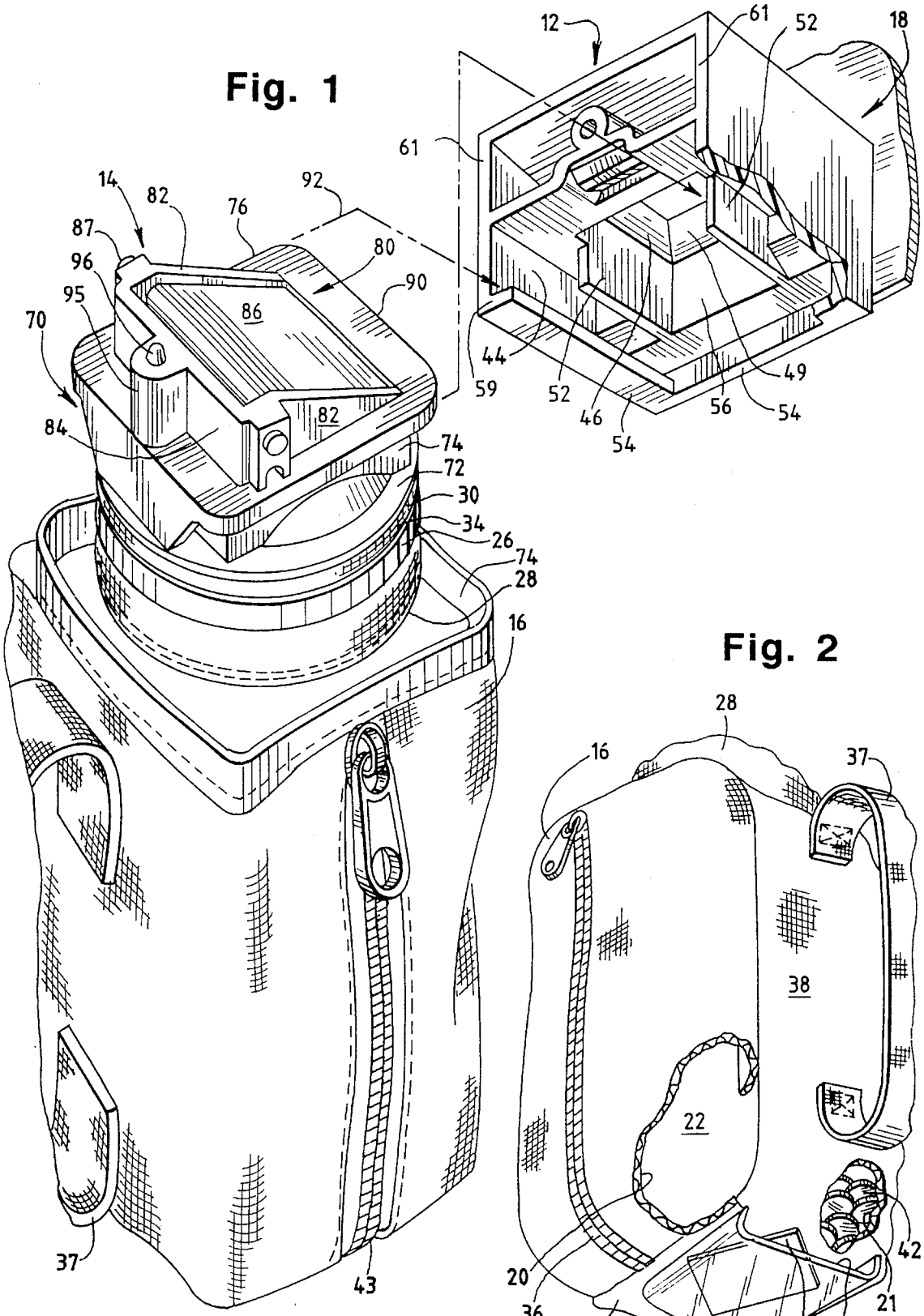
FIG. 1 is an exploded perspective view of the receptacle assembly embodying the invention and showing the two units of the assembly separated but in juxtaposition for being assembled one to the other.
FIG. 2 is a perspective view of the collection bag of the invention with a portion broken away to show an interior wall which provides for two separate storage compartments. Also illustrated is the pocket having an illustrative computer print-out placed therein.

Referring to FIG. 1, the coin and currency receptacle assembly embodying the invention is designated generally by the reference character 10. The assembly 10 is comprised of a funnel unit 12 and a coin and currency receptacle unit 14 to which is attached a flexible bag 16 into which coins inserted into the vending machine (not shown) are deposited when they pass through the funnel unit 12. The two units 12 and 14 are designed to be slidably engaged and disengaged without requiring manual tools. The units 12 and 14 are integrally molded plastic members which eliminate the need for spring actuated slides and catch mechanisms as used in prior art coin receptacle devices for coin vending machines. As depicted generally in FIG. 1, the funnel unit 12 is provided with bracket means designated generally by the reference character 18 which enables the funnel unit to be fixedly installed or anchored at different mounting locations within a coin machine's housing (not illustrated). Such a mounting location may vary between different machines so that the bracket means 18 employed can be modified to accommodate different coin machine mounting locations regardless of where the coin chute delivery is located so long as said funnel unit is properly positioned to receive the coins.

Referring to FIGS. 1 and 2, the bag 16 is made from a sturdy cloth material sewn to provide a pair of interior storage compartments 20 and 21 which are separated by an internal wall 22. The top wall 24 of the bag has an open ended upstanding cylindrical wall 26 of which the lower end 28 communicates with the compartment 21 only. The upper end 30 of the wall 26 is secured over a cylindrical delivery nipple or throat 32 depending from the receptacle unit 16, as best seen in FIG. 7. A clamp 34 encircles the cylindrical wall 26 to clamp the bag 16 around the nipple or throat 32.

The compartment 20 is intended for separate storage of paper currency collected from inside the machine by a service man. Access to the compartment 20 is available through the zipper closure 36. A handle 37 is attached to the side wall 38 of the bag 16 for convenient handling of the bag. A pocket 39 is formed on bottom wall 40 of the bag into which the computer print-out 41 can be placed, as seen through the transparent wall of the pocket 39. As seen in FIG. 2, the coins 42 are collected in the pocket 21. Seen in FIG. 1 is the zipper closure 43 for the coin compartment 21.

Figure 3:
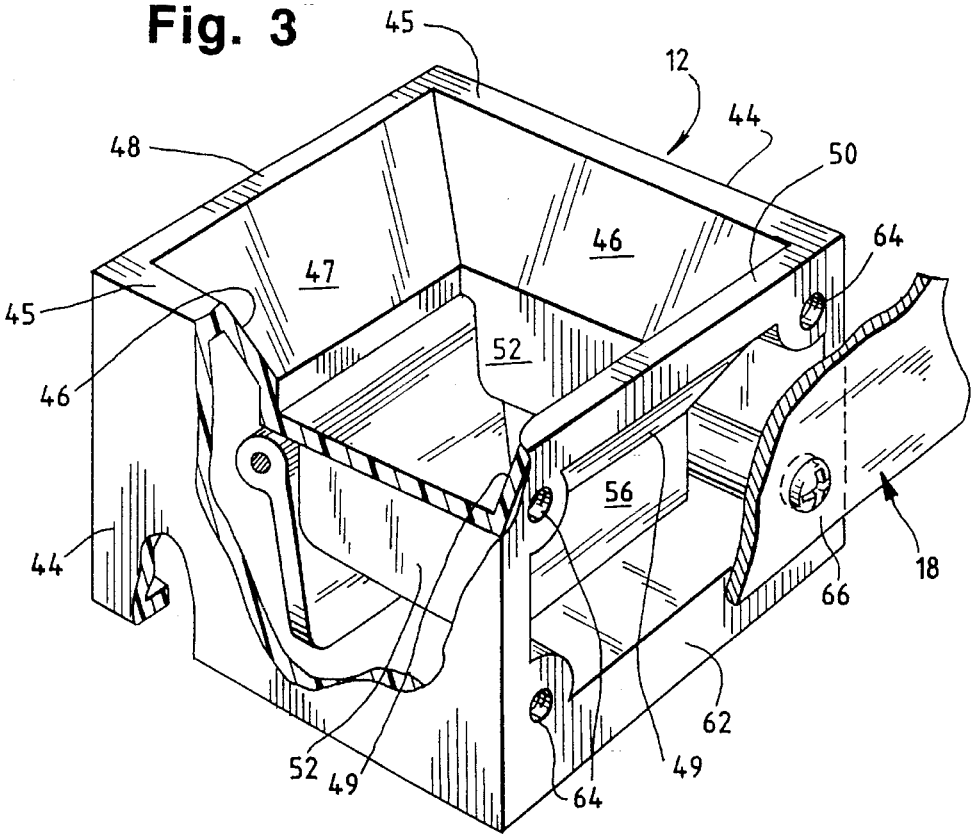
FIG. 3 is top perspective view of one of the two units embodying the invention which receives the coins from the machine, parts being broken away to show the closure means on the interior of the unit and illustrative means for fixedly mounting the unit on the interior of the machine.
Figure 4:
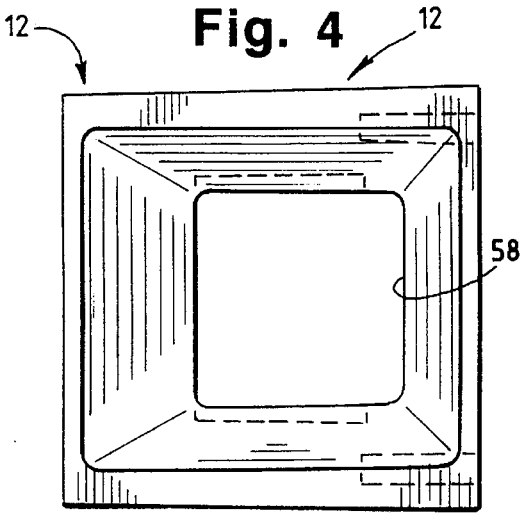
FIG. 4 is a top plan view of the second unit of the invention and which corresponds to the unit depicted on the right hand side in FIG. 1.
Figure 5:
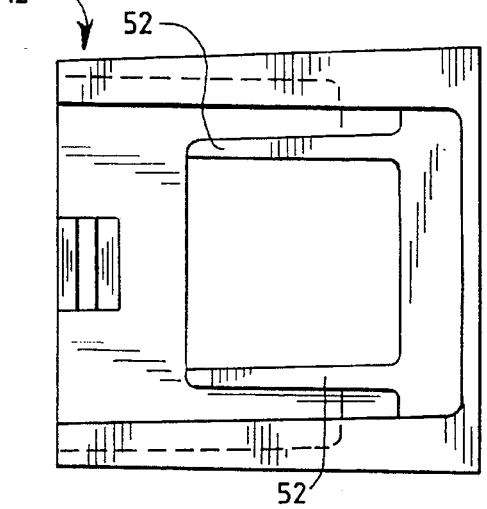
FIG. 5 is a bottom plan view of the unit shown in FIG. 4.

Referring to FIGS. 1, 3 and 4, the funnel member 12 is a unitary structure preferably formed of a high strength synthetic polymer such as polycarbonate. The material from which the funnel member 12 may vary so long as it is of high strength, such as a suitable composite. The member 12 is of rectilinear, box-like configuration comprised of a pair of opposite side walls 44 of equal length and width. The outer surface of each wall 44 is continuous and uninterrupted as seen in the drawings. Commencing from the upper edge 45 of each wall 44, the inner wall surface of the wall 44 is tapered inwardly along a portion of its width and along its entire length to provide a inwardly inclined ramp 46. A similarly dimensioned ramp 47 is formed extending inwardly from the upper edge 48 at right angles to the upper edges 45. Also, a similarly dimensioned ramp 49 is formed extending inwardly from the upper edge 50 also at right angles to the walls 44. As seen in FIG. 3, the ramps 46, 47 and 49 form a four-wall funnel formation which is open at the upper edges 45, 48 and 50.

Each of the ramp walls 46 has an integral wall extension 52 extending downwardly therefrom parallel to the side walls 44 and terminating spaced above the bottom edges 54 of the side walls 44, as best seen in FIG. 1. The ramp wall 49 also has a similarly dimensioned wall extension 56 integral with the wall extensions 52 to form a downwardly opening three-walled extension of the ramp walls 46, 47 and 49 with the exception that the ramp wall 47 is not provided with such a wall extension, as seen in FIG. 1. This leaves an open space opposite the extension 56. The bottom edges of the wall extensions 52 and 56 define the discharge opening 58 of the funnel member 12, as seen in FIG. 4.

As seen in FIG. 1, the wall extensions 52 and 56 have their bottom edges 57 spaced above the bottom edges 54 of the member 12. Extending inwardly from each side wall 44, is a flange 58, the flanges facing one another to provide a ledge 59 on their top surfaces extending inwardly between the walls 44 the entire length of each such wall 44. The ledge 59 thus formed is spaced from the bottom edges 57 of the wall extensions 52 to provide a track extending between the ledge 59 and bottom edges 57. Said extensions 52 function as cams to open the normally closed closure means 80 of the receptacle 14 when the two members are engaged in the said track to form the assembly 10, as further described herein. The ledge 59 terminates flush with the lateral edges 61 defining the open side of the funnel member 12 opposite the side 62 of said member 12.

Referring to FIGS. 1 and 3, the side 62 of the funnel member 12 has a series of four sockets 64 formed in the corners thereof for engaging fasteners therein, such as shown at 66, for securing the bracket member 18 to said side 62. The bracket 18 illustrated is exemplary only, its function being to enable the funnel member 18 to be installed or anchored in the vending machine's housing in a fixed position for receiving coins inserted to activate the vending machine.

The coin and currency receptacle unit 14 is comprised of a unity molded fixture member designated 70 to which the flexible bag 16 is attached to depend therefrom as seen in FIG. 1. The fixture member 70 includes an annular wall 72 from which depends the cylindrical nipple 32 on which the bag 16 is secured by means of the clamp 34, best seen in FIG. 7. Upstanding on the wall 72 is the rectilinear shaped wall 74 on which is supported the platform 76 of rectangular configuration. Supported on the platform 76 is a housing 78 in which is pivotally mounted the closure member 80.

The housing 78 includes a channel-shaped vertical wall in which the parallel side walls 82 are connected by the wall 84. The side walls 82 are triangular in side elevation (FIG. 1) and tapering away from the connecting wall 84. The closure member 80 is comprised of a door 86 which is pivotally mounted on the pivot pin 87 between the side walls 82 adjacent the connecting wall 84. The door 86 is maintained normally in a position closing the space between the side walls 82 by means of the spring 88 mounted on the pivot pin 87 as seen in FIG. 6. The normally closed position of the door 86 is illustrated in FIG. 1 and in broken outline 86' in FIG. 6 where the distal end 89 of the door is urged against the lip 90 in platform 76. The spring 88 is a conventional coiled member from which extend a pair of arms to bias the door 86 to a normally closing position.

The member 70 has a central bore therethrough which connects only with the chamber 21 of the bag. Referring to FIGS. 1, 6 and 7, the receptacle unit 14 is assembled to the funnel unit 12 by inserting the forward end 90 of the platform 76 into the open end of the track in a sliding movement onto the upper surfaces of the ledge 59 as represented by the arrow 92 in FIG. 1. The unit 14 is then slided to the right whereby the cam members 52 will engage the upper surface of the door 86 as seen in FIG. 6 to depress the door 86 downwardly away from the lip as represented by the arrow 93. In this engagement, the door 86 will pivot on the pin 88 against the normal bias there against of the spring 87. The continued sliding movement of the unit 14 on the ledge 59 relative to the funnel unit 12 will further pivot the door 86 to a full open position depicted in FIG. 7.

As seen in FIG. 7, the door 86 is maintained in its open position when the funnel unit 12 is locked on the receptacle unit 14 by the spring biased locking pin 94. The pin 94 is retained in the abutment formation 95 integrally formed externally on the wall 84 and platform 76. The spring 96 on the interior of the formation 95 normally urges the end 96 of pin 94 to protrude outwardly of the formation 95, as seen in FIG. 6. When the funnel unit 12 and receptacle unit are fully engaged (FIG. 7), the pin end 96 is locked in a cavity formation 98 formed in the wall 99 at the entry end into the funnel member 12 (FIG. 1). The cavity 98 has a ramp wall 99 which enables the pin 96 to be withdrawn from the cavity 98 when the units 12 and 14 are to be separated.

The assembly 10 is shown fully engaged in FIG. 7 where the funnel unit 12 is shown astride the receptacle member 14. The door 86 is fully open so that coins dropping into the funnel formation 100 will pass through the passageway 102 into the compartment 21 of the bag 16. When the receptacle unit 14 is withdrawn from the funnel unit 12 in a sliding movement to the left as the assembly is viewed in FIG. 7, the door 86 will be urged by the spring 88 to its normally closed position seen in FIG. 1. A new receptacle unit can then be assembled to the funnel unit 12 anchored in the vending machine in the manner described heretofore.

Minor variations in the configuration, structure and materials described for the funnel unit 12 and receptacle unit 14 may occur to the skilled artisan without departing from the spirit and scope of the invention as recited in the claims hereof.

I claim:

1. A money receptacle assembly for a money operated machine comprising:

a) a unitary molded funnel unit having an upper open end and a lower open discharge end adapted to be anchored on the interior of the machine in position to receive the coins through said upper open end which were inserted into the machine to activate the same;

b) a unitary molded receptacle unit adapted to be removably assembled inside the funnel unit in position to receive the coins passing into the funnel unit and discharged through the lower open end of the funnel member unit;

c) said receptacle unit including a storage container suspended therefrom in position to receive the coins discharged through said lower discharge end of the funnel unit;

d) said funnel unit having internal ledge means opening to a lateral face of the funnel unit and said receptacle unit having complementary wall means adapted to be inserted into the funnel through said opening in a linear movement and engaged along said ledge means for assembly of the receptacle unit with the funnel unit.

2. The assembly according to claim 1 in which said receptacle unit has a pivotal closure member installed in an upper end thereof including means operative to normally bias said closure member to a position closing-off said upper end, said funnel unit having cam means arranged to pivot said closure member to an open position when the receptacle unit is installed inside the funnel unit.

3. The assembly according to claim 2 in which said storage container has a pair of separated chambers therein, one of said chambers located to receive the coins passing through said units.

4. The assembly according to claim 3 in which the other of said chambers is adapted to store currency inserted into the machine for activating the machine.

5. The assembly according to claim 1 in which said units are assembled and dissembled in a sliding movement one relative to the other.

6. The assembly according to claim 5 in which said units have cooperating pin and socket locking means for retaining the units together when assembled.

7. The assembly according to claim 1 including bracket means secured to an end face of the funnel unit for anchoring said unit on the interior of the machine in position to receive said inserted coins.

8. An assembly for collecting money inserted into a vending machine comprising:

a) a unitary molded funnel member open at opposite upper and lower ends thereof for passing coins therethrough inserted into the machine, said member including bracket means for anchoring the member on the interior of the machine in position for accepting coins inserted into the machine;

b) a unitary molded receptacle fixture member adapted to be slidably engaged into said funnel member to complete the assembly for receiving coins passing through the funnel member;

c) said fixture member having a bag suspended therefrom in position to collect the coins passing through the members;

d) said members having cooperating locking means for releasably locking the members together when the assembly is completed;

e) said funnel member having a pair of inwardly facing ledges open to a lateral face of the funnel member to provide a track, said fixture member having a protruding wall arranged to be inserted along said track for assembly of said fixture member with said funnel member.

9. The assembly according to claim 8 in which said fixture member has a pivotal door spring-biased to a position normally preventing entry thereinto of coins, said funnel member having cam means arranged to engage and pivot the door to an open position permitting coins to pass into the bag when the two members are completely assembled.

10. The assembly according to claim 9 in which said cam means comprise a pair of walls depending from a pair of funnel walls.

11. The assembly according to claim 8 in which said cam means comprise a pair of walls depending from a pair of funnel walls spaced above said track whereby sliding movement of the fixture member into the funnel member along the track will engage the depending walls against the door an open the door when the assembly is completed.

12. The assembly according to claim 8 in which said locking means comprise a spring biased pin mounted on the fixture member and a socket for receiving the pin therein on the funnel member.

* * * * *

UNITED STATES PATENT AND TRADEMARK OFFICE

CERTIFICATE OF CORRECTION

PATENT NO. : 5,611,483
DATED : March 18, 1997
INVENTOR(S) : Michael J. Sciortino It is certified that error appears in the above-identified patent and that said Letters Patent is hereby corrected as shown below:

Column 5, line 26, after "open" insert --discharge--;

line 27, delete "member";

line 30, after "lower" insert --open--;

line 35, after "funnel" insert --unit--;

Column 6, line 48, change "an" to --and--.

Signed and Sealed this

First Day of July, 1997

Bruce Lehman

*Attest:*

BRUCE LEHMAN

*Attesting Officer*

*Commissioner of Patents and Trademarks*